US005899210A

United States Patent [19]

Letherby et al.

[11] Patent Number: 5,899,210

[45] Date of Patent: May 4, 1999

[54] NAIL TOOL HAVING MULTIPLE SURFACES

[75] Inventors: Anne M. Letherby, Grand Rapids; Lawrence D. Gaynor, West Bloomfield, both of Mich.

[73] Assignee: Nailco, Inc., Farmington Hills, Mich.

[21] Appl. No.: 09/001,278

[22] Filed: Dec. 31, 1997

[51] Int. Cl.[6] ..... A45D 29/18

[52] U.S. Cl. ..... 132/76.4; 132/73

[58] Field of Search ..... 132/76.4, 76.2, 132/73, 75.6, 76.5; 451/523, 525, 506, 538, 552, 557; 51/293, 295, 298, 358

[56] References Cited

U.S. PATENT DOCUMENTS

| | | | |
|---|---|---|---|
| D. 387,489 | 12/1997 | Salvino | D28/59 |
| D. 388,904 | 1/1998 | Atkinson | D28/59 |
| D. 389,957 | 1/1998 | Huang | D28/59 |
| 2,557,175 | 6/1951 | Cortes | 132/76.4 |
| 2,838,057 | 6/1958 | Smith | 132/76.4 |
| 4,246,914 | 1/1981 | Keyser | 132/76.4 |
| 5,177,909 | 1/1993 | Klocke | 51/358 |

*Primary Examiner*—Gene Mancene
*Assistant Examiner*—Pedro Philogene
*Attorney, Agent, or Firm*—Dykema Gossett PLLC

[57] ABSTRACT

A nail tool has a triangular, elongate tube which provides three planar surfaces and at least two corners. The planar surfaces provide a treatment surface such as an abrasive which is disposed on an intermediate layer of resilient foam. The tube is hollow which helps reduce weight.

12 Claims, 1 Drawing Sheet

NAIL TOOL HAVING MULTIPLE SURFACES

The present invention relates generally to abrasive articles of the type used by nail technicians to file, shape, polish and buff natural and artificial nails. More specifically, the present invention relates to a unique multi-surfaced nail tool.

BACKGROUND OF THE INVENTION

A number of prior art nail tools have been used by nail technicians to remove incremental quantities of natural or artificial nail surfaces. The most common of these is the nail file which is traditionally in the form of a narrow, flat strip having two opposed planar surfaces. A surface layer of an abrasive material ("grit") is bonded to each planar surface or, in the case of metal nail files, the surfaces are scored to provide an abrasive surface. Most often the relative coarseness of the abrasive surfaces differ, e.g., one surface being a medium grit for the quick removal of material and the other surface being a fine grit for polishing the nail surface.

Many conventional nail files are generally too flexible, resulting in unwanted bending and breaking. In addition, limiting the surfaces of a file to a single grit is inconvenient to the nail technician since more variability in grades of coarseness is often desirable to provide a smooth, highly-polished nail surface. In addition, flat boards are often difficult to hold and manipulate at angles necessary to provide optimum results and produce technician fatigue. Finally, most conventional nail boards cannot be washed and reused.

Accordingly, a nail tool is needed in the industry which allows the nail technician to easily hold and manipulate the tool for maximum efficiency in forming and shaping nails without requiring frequent repositioning of the tool in the technician's hand. There is further a need for a nail tool having the aforementioned attributes which is also adapted to provide a plurality of faces for extended service life. Finally, there is a need for a nail tool which provides a plurality of corners for cuticle work.

It is therefore an object of the present invention to provide a nail tool which can be easily handled by a technician and which meets the aforementioned needs.

SUMMARY OF THE INVENTION

In one aspect the present invention provides a nail file or tool for abrading fingernails and toenails which is particularly useful in shaping and polishing artificial nails. The unique nail tool comprises a hollow elongate body having a length at least twice its circumference. The elongate body has three planar faces which intersect to form three rounded edges or corners, at least two of which are designed to be used for cuticle treatment as will be described more fully hereinafter. Thus, the elongate body is in the form of a triangular tube. The planar surfaces each have a treatment portion such as an abrasive surface suitable for treating the surface of a fingernail or toenail.

In another aspect, the nail tool of the present invention again comprises a hollow, rigid, elongate base having a length at least twice its circumference. The elongate base has three planar faces which intersect at rounded corners such that the elongate base is in the form of a triangular tube. Each of the planar faces in this aspect has a principal surface with a layer of preferably waterproofed resilient foam attached thereto. An abrasive layer is bonded to the layer of foam such that three distinct abrasive nail filing surfaces and at least two corners for cuticle treatment are defined.

DETAILED DESCRIPTION OF THE PREFERRED EMBODIMENTS OF THE INVENTION

Figure 1:
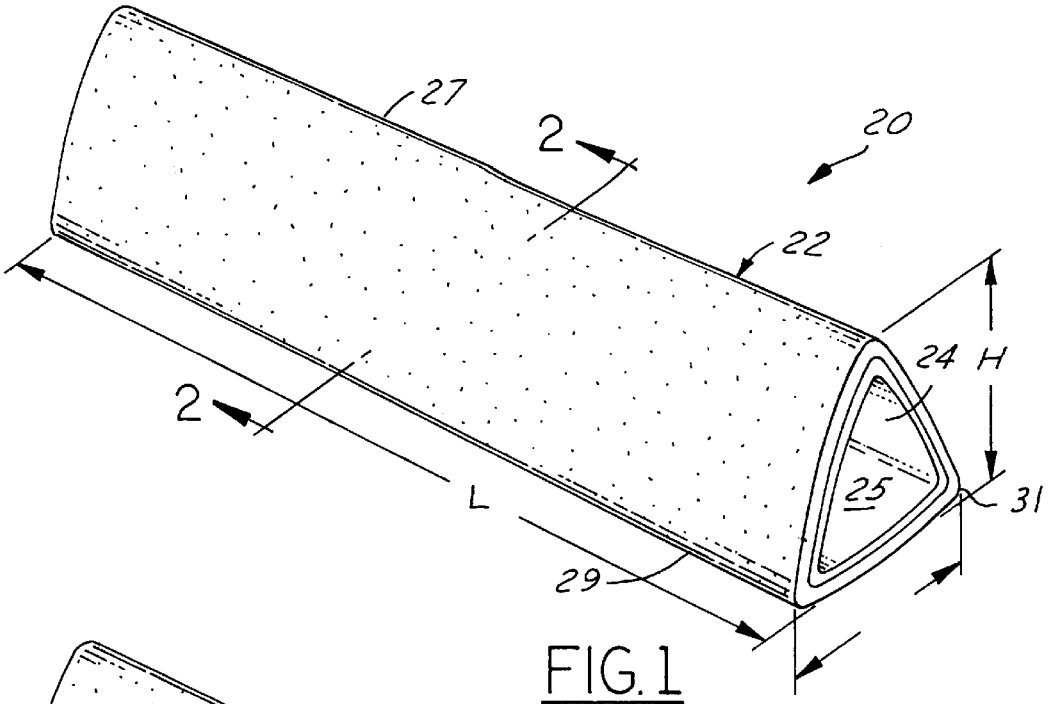
FIG. 1 is a perspective view of the nail file of the present invention.

Referring now to FIG. 1 of the drawings, nail file or tool 20 is shown having elongate body 22. The overall dimensions of body 22 may vary; however, body 22 will typically have a length (L) of from about 6¾ to about 7¼ inches, a width (W) of from about 1 to about 1¼ inches, and a height (H) of about 1 to about 1¼ inches. Most preferably, tool 20 will have a length at least twice its circumference.

Body 22 in the most preferred embodiment has a rigid base 24 which is hollow and which defines cavity 25. Rigid base 24 is formed of a lightweight plastic such as polyvinyl chloride and has a wall thickness of from about ¼ inch to about ⅜ inch. The preferred method of forming rigid base 24 is through the use of plastic extrusion technology although other methods may be acceptable.

Figure 2:
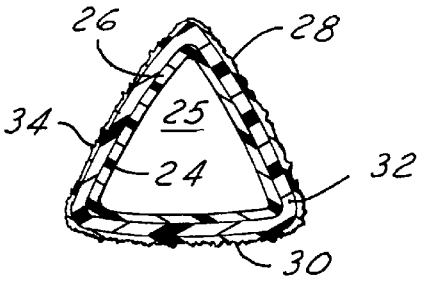
FIG. 2 is a cross section along lines 2—2 of FIG. 1.

As best seen in FIG. 2 of the drawings, rigid base 24 defines three distinct surfaces or faces, principal surfaces 26, 28 and 30. In order to provide a nail tool which is easily manipulated by the nail technician and which provides both broad filing/polishing surfaces and rounded corners for working on cuticles, the three faces of rigid body 24 intersect to form a triangular tube as best seen in FIGS. 1 and 2 of the drawings having corners 27, 29 and 31.

Nail tool 20 has a layer 32 that overlies and is bonded to rigid base 24 at principal surfaces 26, 28 and 30. Layer 32 preferably provides resilience which is particularly desirable in filing the contoured surfaces of nails. Layer 32 will typically be formed of a foam such as polyethylene. Layer 32 may be in the form of a single sheet or may comprise individual rectangular sheets with one sheet being attached to each principal surface. Layer 32 has a thickness of preferably between about 1/32 to ⅛ inch. Most preferably layer 32 is co-extensive with the entire surface of faces 26, 28 and 30; that is, it substantially completely covers these surfaces.

Figure 3:
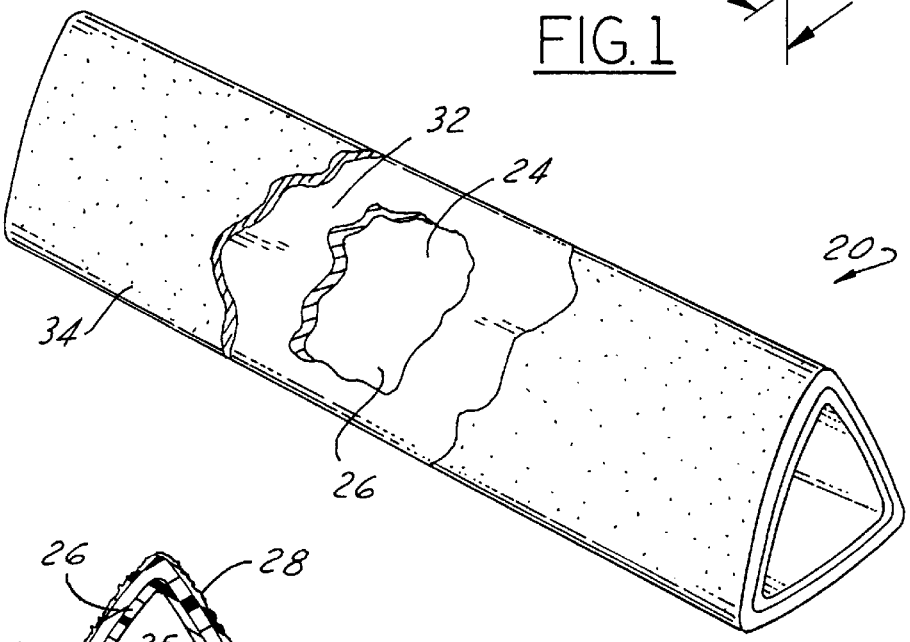
FIG. 3 is fragmented view of the nail file of FIG. 1 illustrating the various layers of the device.
Figure 4:
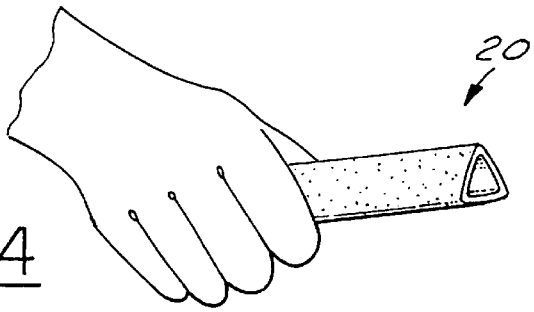
FIG. 4 illustrates the use of the nail file of FIG. 1 being shown held by a nail technician.

Referring now to FIGS. 3 and 4, surface 34 is seen which forms the outermost layer or surface of nail file 20. In one preferred embodiment, surface 34 is an abrasive material. As will be appreciated by those skilled in the art a number of materials are available which can provide the necessary surfaces used in the present invention. One of the preferred treatment materials is abrasive grit which is typically formed of abrasive particles in the nature of silicon carbide or aluminum oxide. Surface 34 may constitute a separate layer of material, for example abrasive particles bonded to a thin sheet of paper-like material, or it may also be formed by attaching the abrasive particles directly to the outer surface of resilient layer 32 through the use of a bonding agent. Alternatively, for polishing and other nail treatments other surfaces such as buffing fabric or mylar plastic may be utilized for surface 34.

An important feature of the present invention is provided by rounded corners 27, 29 and 31. Rounded corners 27, 29 and 31 will each be typically less than 110 degrees and most preferably about 90 degrees (radius). In those embodiments in which an abrasive surface is formed by a planar sheet wrapped around base 24 (and note that an abrasive sheet may be laminated to a resilient pad with the resultant laminate being wrapped around base 24) at least two corners (e.g. 27 and 29) will be suitable for use in filing cuticles. That is, they will be rounded somewhat and will be of a size and shape which allows the cuticles to be accessed.

By providing cavity 25 and through the use of plastic and foam in the construction of tool 20, the present invention provides an extremely lightweight yet versatile nail tool. Typically tool 20 will weigh less than two ounces. Nail tool 20 is shown being held by a nail technician in FIG. 4 of the drawings. This construction allows the nail technician to work continuously without frequent repositioning of tool 20 which reduces fatigue.

In one embodiment of the invention, all of the components of nail tool 20 are water resistant such that surface 34 can be readily washed with soap and water or the like. Alternatively, tool 20 can be disposable. In addition, while in the preferred embodiment, a single type of surface 34 is present on each face of the tool, in another embodiment different surface qualities are provided on each face. More specifically, each face 26, 28 and 30 may have its own specific surface. That is, a coarse grit could be applied to face 26, a medium grit to face 28 and a fine grit to face 30. It may be possible to place grit on one face and cloth or mylar on another face. This allows a nail technician to easily flip faces during the manicure or pedicure to provide the proper surface. In addition, different regions of each face can have different grades of abrasive. In other words, a single face (e.g., face 26) can be subdivided such that one end has a fine grit and the other has a coarser grit. Similarly, each face can be subdivided to provide three grades of grit.

In still another embodiment of the present invention, abrasive surface or layer 34 is an abrasive sheet in the form of a disposable sleeve which can be replaced when worn. Accordingly, the abrasive sleeve fits over rigid base 24.

While particular embodiments of this invention are shown and described herein, it will be understood, of course, that the invention is not to be limited thereto since many modifications may be made, particularly by those skilled in this art, in light of this disclosure. It is contemplated, therefore, by the appended claims, to cover any such modifications as fall within the true spirit and scope of this invention.

What is claimed is:

1. A nail tool comprising:

a hollow elongate body having a length at least twice its circumference;

said elongate body having three planar faces which intersect such that said elongate body is in the form of a triangular tube;

each of said planar faces having a treatment portion suitable for treating the surface of a fingernail or toenail; and said tool having at least two rounded corners formed by the intersection of said planar faces.

2. The nail tool recited in claim 1, wherein said treatment portion is selected from the group consisting of abrasive grit, buffing fabric and mylar.

3. The nail tool recited in claim 1, wherein said elongate body includes a rigid plastic portion and a resilient portion.

4. The nail tool recited in claim 3, wherein said resilient portion overlays said rigid plastic portion and wherein said abrasive portions overlie said resilient portion.

5. The nail tool recited in claim 1, wherein the abrasive portion of each of said faces has a different coarseness grade.

6. The nail tool recited in claim 1, wherein said nail tool is constructed of water-resistant materials and is washable.

7. A nail tool comprising:

a hollow rigid elongate base having a length at least twice its circumference;

said elongate base having three planar faces which intersect such that said elongate base is in the form of a triangular tube and such that at least two corners are formed;

each of said planar faces having a principal surface;

a layer of resilient foam disposed on and bonded to said planar faces and overlying said corners; and a layer of treatment materials disposed on and bonded to said layer of foam.

8. The nail tool recited in claim 7, wherein said treatment material layer is selected from the group consisting of abrasive grit, buffing fabric and mylar.

9. The nail tool recited in claim 7, wherein said treatment material layer is formed of abrasive particles.

10. The nail tool recited in claim 7, wherein said elongate base has a cross-section which is approximately an equilateral triangle.

11. The nail tool recited in claim 7, wherein said elongate body has a length between about 6¾ and about 7¼ inches.

12. The nail tool recited in claim 7, wherein said treatment layer is washable material.

* * * * *